US009263208B2

(12) United States Patent
Laurent et al.

(10) Patent No.: US 9,263,208 B2
(45) Date of Patent: Feb. 16, 2016

(54) TACTILE-SURFACE CONTROL MODULE, IN PARTICULAR FOR A MOTOR VEHICLE

(75) Inventors: Patrice Laurent, Annemasse (FR); Xavier Drouin, Annemasse (FR); Stephane Dalmayrac, Annemasse (FR)

(73) Assignee: DAV, Créteil (FR)

( * ) Notice: Subject to any disclaimer, the term of this patent is extended or adjusted under 35 U.S.C. 154(b) by 1123 days.

(21) Appl. No.: 12/742,748

(22) PCT Filed: Nov. 13, 2008

(86) PCT No.: PCT/EP2008/065481

§ 371 (c)(1),
(2), (4) Date: Sep. 22, 2010

(87) PCT Pub. No.: WO2009/065767

PCT Pub. Date: May 28, 2009

(65) Prior Publication Data

US 2011/0006930 A1 Jan. 13, 2011

(30) Foreign Application Priority Data

Nov. 20, 2007 (FR) ..... 07 08146

(51) Int. Cl.
*H01H 13/83* (2006.01)
*H01H 13/702* (2006.01)

(52) U.S. Cl.
CPC ..... *H01H 13/702* (2013.01); *H01H 2209/06* (2013.01); *H01H 2209/082* (2013.01);
(Continued)

(58) Field of Classification Search
CPC ..... H01H 200/466
USPC ..... 200/345, 343, 310–314
See application file for complete search history.

(56) References Cited

U.S. PATENT DOCUMENTS 7,005,588 B2 * 2/2006 Pihlaja ..... 200/5 A
7,071,434 B1 * 7/2006 McConnell et al. ..... 200/310

(Continued)

FOREIGN PATENT DOCUMENTS

DE 26 13 024 A1 9/1977
DE 197 02 957 A1 8/1998

(Continued)

OTHER PUBLICATIONS

International Search Report w/translation from PCT/EP2008/065481 dated Feb. 16, 2009 (4 pages).

*Primary Examiner* — Renee S Luebke
*Assistant Examiner* — Ahmed Saeed
(74) *Attorney, Agent, or Firm* — Osha Liang LLP

(57) ABSTRACT

The present invention relates to a tactile-surface control module comprising: a flexible protection layer (9), at least one monostable switch (11) and a rigid mechanical supporting member (13) letting through the light from at least one light source and defining regions for backlighting the flexible protection layer (9), characterized in that said supporting member (13) further includes at least one passage (21) for activating the monostable switch (11), by deformation of the flexible protection layer (9), and in that the module includes a sheet (19) made of incompressible material sandwiched between said rigid mechanical supporting member (13) and the flexible protection layer (9), the sheet (19) defining at least one pivoting arm (23) comprising a hinge (25), joined to said supporting member (13), and a pivoting free end (27) having an actuating lug (29) placed facing a passage (21) in said supporting member (13) for actuating the monostable switch (11).

10 Claims, 2 Drawing Sheets

Figure 3:
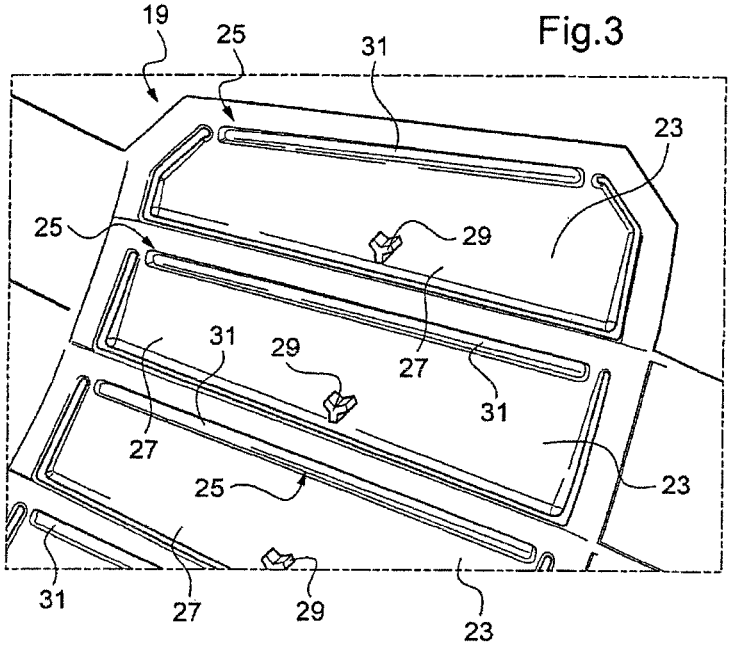

(52) U.S. Cl.
CPC ..... *H01H2221/07* (2013.01); *H01H 2221/074* (2013.01); *H01H 2221/076* (2013.01); *H01H 2223/003* (2013.01); *H01H 2229/028* (2013.01); *H01H 2231/026* (2013.01)

(56) References Cited

U.S. PATENT DOCUMENTS 7,518,381 B2 * 4/2009 Lamborghini et al. ..... 324/679
2007/0235295 A1 * 10/2007 Verma et al. ..... 200/5 A

FOREIGN PATENT DOCUMENTS

| | | | | | |
|---|---|---|---|---|---|
| DE | 197 05 536 | A1 | | 8/1998 | |
| DE | 199 35 386 | A1 | | 2/2001 | |
| EP | 0 803 711 | A1 | | 10/1997 | |
| EP | 1 176 619 | A2 | | 1/2002 | |
| GB | 2 354 738 | A | | 4/2001 | |
| JP | H 11111098 | | * | 4/1999 | ..... H01H 13/02 |
| WO | 2005/035299 | A1 | | 4/2005 | |

* cited by examiner

Fig.1
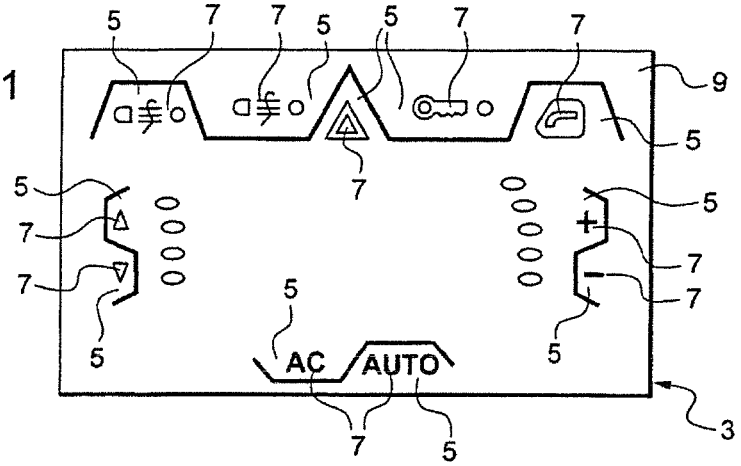
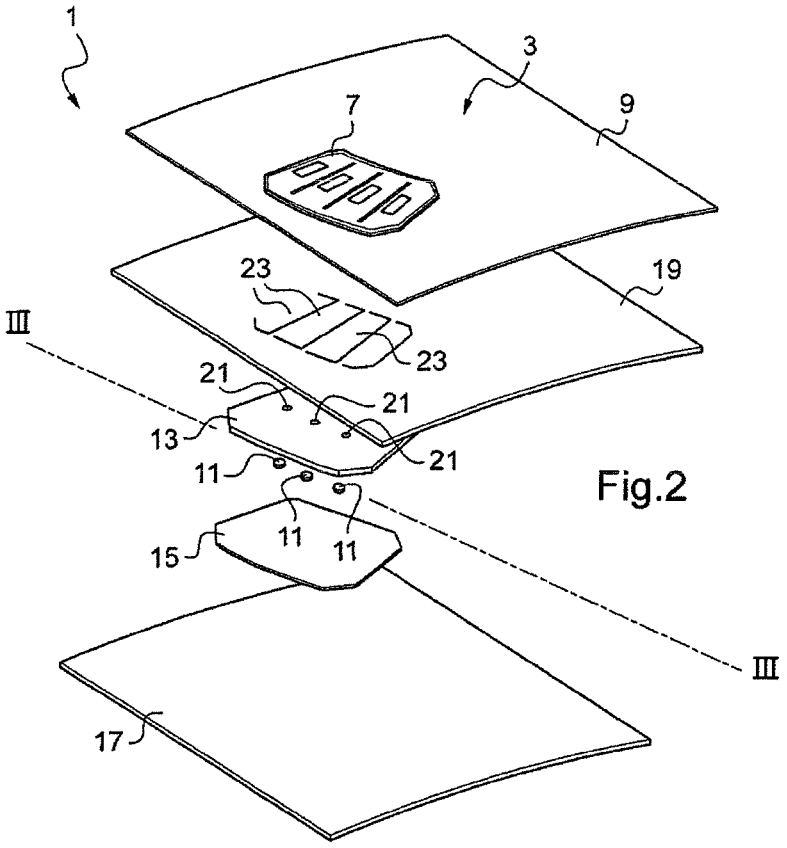
Fig.2

TACTILE-SURFACE CONTROL MODULE, IN PARTICULAR FOR A MOTOR VEHICLE

The present invention relates to a touch-sensitive-surface control module, in particular for a motor vehicle.

More precisely, such a module finds an advantageous application for controls that are on the console between the two front seats of a motor vehicle in order, for example, to control the functions of air-conditioning, of an audio system, of a telephony system or else of a navigation system. The invention may also be applied in a region of the vehicle called the dome which is situated in the usual location of the internal rear-view mirror, in order for example to control the interior lights, a central locking function, a sun roof, the hazard warning lights or the ambience lights. This module may also be used for the window-winder controls, the controls for positioning outside mirrors or else controls for moving motorized seats.

Control modules are known that are capable of lighting the controls for night driving in a motor vehicle, the lighting being produced via the rear face. For example, during daylight driving, the driver clearly perceives a white pictogram on the button and, during night driving, the backlighting allows the driver to easily locate the control.

Other modules are also capable of providing a haptic feedback making it possible to inform the user that the detection has been made and the switching taken place. For example, monostable-switch control modules are known such as the blister, making it possible to provide a haptic feedback to the user.

The blister or "blister dome" is a monostable switch with actuation by pressure, that is to say a device having a stable rest position and an unstable position in which the apex of the elastic blister dome deforms when a force is applied. The deformation of the blister is proportional to the force applied up to a transition of the blister. During the transition, the blister deforms suddenly which allows the generation of a haptic information feedback to the user, informing him of the achievement of a switching action in the case in which, for example, a switching action takes place by deflection of the blister dome between the dome and two tracks to be connected on a printed circuit.

However, the integration of haptic feedback devices in control modules already having backlighting functionalities is not always easy, in particular when the haptic feedback requires the deformation of a flexible protective layer.

The touch-sensitive control surface may then have an uneven appearance, for example with rough parts or bulges that may cause premature wear of the control device.

The object of the present invention is to propose a control module with haptic feedback benefiting from backlighting for better identification of the functions to be controlled, while having a uniform tactile sensation over the whole control surface.

Accordingly, the subject of the invention is a touch-sensitive-surface control module comprising:

- a flexible protective layer,
- at least one monostable switch and
- a rigid mechanical support allowing light to pass through from at least one light source and defining backlighting regions of the flexible protective layer, characterized in that said support also comprises at least one passageway to allow the activation of the monostable switch, by deformation of the flexible protective layer and in that the module comprises a plate made of an incompressible material sandwiched between said rigid mechanical support and the flexible protective layer, the plate delimiting at least one pivoting vane comprising on the one hand a hinge assembled to said support and on the other hand a pivoting free end comprising an actuation locator placed facing a passageway of said support in order to activate the monostable switch.

According to other features of the control module,

- the monostable switch comprises a blister dome,
- the control module also comprises a pressure-sensitive sensor placed beneath the monostable switch,
- the flexible protective layer is attached at the hinge of the plate, preferably by bonding,
- the hinge is formed by a thinning of the plate allowing said vane to pivot,
- the plate and/or the support is (are) made of a transparent or translucent material,
- the flexible protective layer comprises control symbols or signs made of a material allowing the light to pass through at least partially,
- the module is capable of controlling the functions of at least one set of electric or electronic members of a motor vehicle, such as an air-conditioning system, an audio system, a navigation system, a telephony system, motorized window-winder controls, controls for adjusting outside mirrors, controls for adjusting the position of a sun roof, interior lighting controls, controls for adjusting a seat of a motor vehicle.

Figure 4:
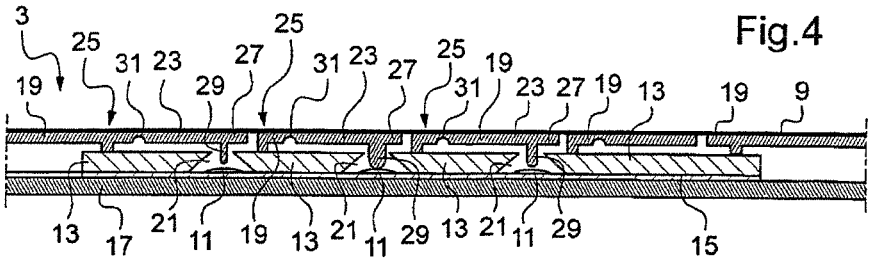
Figure 5:
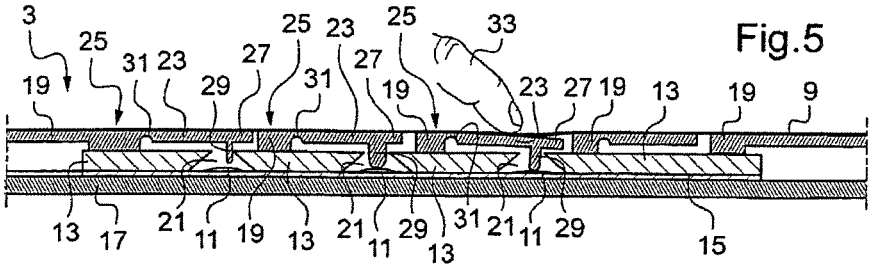

Other features and advantages of the invention will become apparent from the following exemplary description nonlimiting in character, with respect to the appended drawings in which:

FIG. 1 represents a top view of an exemplary embodiment of a control device according to the invention, FIG. 2 represents an exploded view of another control device according to the invention, FIG. 3 represents a detail of the device of FIG. 2, FIG. 4 illustrates a view in cross section on the line III-III of the control device of FIG. 2 and, FIG. 5 represents the control device of FIG. 4 activated by a finger of the user.

In these figures, identical elements bear the same reference numbers.

The control device according to the invention is capable of controlling at least one electric or electronic member of a motor vehicle such as, for example, air-conditioning, an audio control, a navigation system, a telephony system, a motorized window-winder control, a control for adjusting an outside mirror, a control for adjusting the position of a sun roof, an interior lighting control or a control for adjusting a seat of a motor vehicle.

FIG. 1 shows a touch-sensitive control surface 3 of a control device, defining touch-sensitive zones or selector buttons 5 of electric or electronic control members comprising a symbol 7 or an inscription of a letter or letters or a figure or figures relating to the function to be controlled.

In this example, the touch-sensitive control surface 3 comprises eleven buttons 5 on which are symbolized the controls for the fog lights at the front and rear of the vehicle, for the hazard warning lights, for internal locking, for adjusting the fan or the temperature control.

The symbol 7 can be seen permanently according to a first embodiment or according to a second embodiment, only if backlighting is applied.

For this purpose, the touch-sensitive surface 3 comprises a flexible protective and decorative layer 9, which makes it possible to locally transmit a pressure and which comprises symbols 7 made of a material that allows the light to pass through at least partially.

According to first variant, the flexible layer 9 is for example made of silicone.

According to a second variant, the flexible layer 9 is made of a plastic film, for example of polycarbonate. The symbols/signs 7 can be produced by screen printing on the underside of the plastic film.

According to a third variant, this flexible layer 9 is made according to the "Black Panel" technology which is described in documents DE2613024, DE19702957, DE19705536, DE19935386, EP0803711 or WO2005035299. In this case, the symbols/signs 7 such as the numbers, letters or pictograms are made so that they are visible only with backlighting. Consequently, in the absence of a light source, the protective layer 9 appears uniform with no indication or writing on the touch-sensitive surface. In this case, the flexible protective layer 9 is advantageously made of a sheet of polycarbonate.

As can be seen more clearly in FIG. 2, in the disassembled state, the control device 1 comprises, beneath the flexible protective layer 9, a plate 19, a rigid mechanical support 13 and at least one monostable switch 11.

A printed circuit board 15 is preferably placed beneath the monostable switch 11 and is supported by a base 17.

The monostable switch 11 allows the generation of a haptic feedback to the user informing him of the electric switching of the control member.

Preferably, the monostable switch 11 comprises a blister dome.

Three blister domes 11 can be distinguished in FIGS. 2, 4 and 5. The blister dome 11 is elastic and preferably metallic. For example, the blister dome 11 comprises a general shape that is substantially concave, the base of which comprises at least three evenly distributed lugs.

The switching takes place for example by deflection of the blister dome 11 between the apex of the dome and two tracks to be connected on the printed circuit board 15, the deformation of the blister dome 11 generating a haptic feedback to the user.

According to another particular embodiment of the invention, the control module 1 advantageously comprises a pressure-sensitive sensor (not shown) placed beneath the monostable switch 11.

These sensors are sensitive to a compression which, by slightly reducing their thickness, results in an electric signal that can be used to ascertain the location of the support and/or the pressure applied. This sensor is preferably an FSR-technology sensor.

Moreover, the sensor makes it possible to produce an electric contact during the compression of the sensor in order to control a specific electric function.

The mechanical support 13 is for example made of plastic and allows light to pass through from at least one light source, such as a light-emitting diode defining regions of backlighting of the symbols or inscriptions of letter(s) 7 of the flexible protective layer 9.

The light sources (not shown) are supported by the printed circuit board 15. Preferably, one light source per backlighting region is provided.

If it is desired to use low-power light-emitting diodes, a transparent support 13 is preferred because it does not reduce the light power emitted by the sources.

If it is desired to obtain a more uniform and homogeneous lighting, in particular if the size of the backlighting zone is large relative to the size of the light source, a translucent or even milky support 13 is preferred to homogenize the light emitted by the sources.

The support 13 also comprises at least one passageway 21 (three in the example illustrated in FIG. 2) in order to allow the activation of the monostable switch 11, by deformation of the flexible protective layer 9.

Moreover, the module 1 comprises a plate 19 made of an incompressible material, sandwiched between the rigid mechanical support 13 and the flexible protective layer 9. "Incompressible" means that a user cannot reduce the thickness thereof by pressing on the plate 19.

As can be more clearly seen in FIGS. 3, 4 and 5, the plate 19 delimits at least one pivoting vane 23 comprising on the one hand a hinge 25 assembled to the support 13 and on the other hand a pivoting free end 27 comprising an actuation locator 29 placed facing a passageway 21 of the support 13 in order to activate the monostable switch 11.

The pivoting of the end 27 of the vane 23 allows the monostable switch 11 to be switched by the actuation locator 29 placed facing the passageway 21 of the support 13.

The vane 23 is placed beneath a button 5 for selecting control members of the touch-sensitive control surface 3 and has substantially the same dimensions as the button 5.

Preferably, the hinge 25 is made of the same material as the plate 19 and is formed by a thinning 31 of the section of the plate 19 allowing the vane 23 to pivot.

This embodiment of pivoting by hinge 25 makes it possible to activate the monostable switch 11 placed underneath, irrespective of the position of the finger 33 of the user on the surface of the button 5.

This arrangement is particularly suitable for producing elongated buttons 5, having for example a length of the order of 40 mm for a length of the order of 10 mm. The flexible protective layer 9 is for example attached to the fixed zones of the plate 19 at the hinges 25, preferably by bonding.

Conversely, the flexible protective layer 9 is left free at the vanes 23 so as to allow the vanes 23 to pivot.

The deformation of the flexible protective layer 9 is then carried out over the whole of the vane 23.

The plate 19 is preferably made of a material allowing light to pass through, that is to say transparent or translucent, preferably made of polycarbonate.

The vane 23 is therefore movable by pivoting between a raised rest position (a substantially horizontal position) illustrated in FIG. 4 or on the left of FIG. 5 and an active position (a position slightly lower than the rest position) illustrated on the right in FIG. 5.

The latter position is for example obtained by pressing with the end of the finger 33 on the vane 23.

The flexible layer 9 is slightly deformed elastically in order to allow the vane 23 to pivot toward the activation of the monostable switch 11 and therefore toward the initiation of a specific control.

As an example, the travel of the free end 27 in order to lower toward an actuation position is between less than a millimeter, for example 0.4 to 0.5 mm. Preferably, the actuation position is the end-of-travel position obtained when a pressure is applied.

Therefore, the support 13 used as a light guide for the light from the light sources also makes it possible to hold the plate 19 while allowing it to deform for the tilting of the control button.

The control module 1 obtained therefore incorporates backlighting and haptic feedback functions while retaining, on the flexible protective layer 9, a touch-sensitive control surface 3 that is continuous and perfectly smooth. In this way it is understandable that the touch-sensitive surface 3 comprises no rough part or hole, except for those purposely produced for ergonomic reasons, for example for the location of the buttons 5.

It can be understood that the touch-sensitive-surface control module 1 comprising a support 13 comprising at least one passageway 21 in order to allow the activation of the monostable switch 11, by deformation of the flexible protective layer 9 and a plate 19 sandwiched between the rigid mechanical support 13 and the flexible protective layer 9, the plate 19 delimiting at least one pivoting vane 23, the end of which is placed facing a passageway 21 of said support 13 to activate the monostable switch 11, makes it possible to obtain a control module 1 that has haptic feedback, is backlit and has a control surface 3 with no unevenness.

The invention claimed is:

1. A touch-sensitive-surface control module comprising:

a flexible protective layer, at least one monostable switch;

a rigid mechanical support allowing light to pass through from at least one light source and defining backlighting regions of the flexible protective layer, wherein the mechanical support comprises at least one passageway to allow the activation of the at least one monostable switch, by deformation of the flexible protective layer; and a plate made of an incompressible material enclosed directly between said rigid mechanical support and the flexible protective layer, the plate delimiting at least one pivoting vane comprising a hinge assembled to said mechanical support and a pivoting free end comprising an actuation locator placed within a passageway of said mechanical support, the actuation locator facing the at least one monostable switch in order to activate the at least one monostable switch.

2. The control module as claimed in claim 1, wherein the at least one monostable switch comprises a blister dome.

3. The control module as claimed in claim 1, further comprising a pressure-sensitive sensor placed beneath the at least one monostable switch.

4. The control module as claimed in claim 1, wherein the flexible protective layer is attached at the hinge of the plate by bonding.

5. The control module as claimed in claim 1, wherein the hinge is formed by a thinning of the plate, allowing said vane to pivot.

6. The control module as claimed in claim 1, wherein the plate and the mechanical support are made of a transparent or translucent material.

7. The control module as claimed in claim 1, wherein the flexible protective layer comprises control symbols or signs made of a material that allows the light to pass through at least partially.

8. The control module as claimed in claim 1, wherein the control module is capable of controlling the functions of at least one set of electric or electronic members of a motor vehicle.

9. The control module as claimed in claim 8, wherein the at least one set of electric or electronic members of a motor vehicle comprise at least one selected from a group consisting of an air-conditioning system, an audio system, a navigation system, a telephone system, motorized window-winder controls, controls for adjusting outside mirrors, controls for adjusting the position of a sun roof, interior lighting controls, and controls for adjusting a seat of a motor vehicle.

10. The control module as claimed in claim 1, wherein the hinge of the at least one pivoting vane is directly assembled to said mechanical support.

* * * * *